US010165370B2

(12) United States Patent
Zhang et al.

(10) Patent No.: US 10,165,370 B2
(45) Date of Patent: Dec. 25, 2018

(54) LOUDSPEAKER

(71) Applicants: Fan Zhang, Shenzhen (CN); Sheng Ren, Shenzhen (CN)

(72) Inventors: Fan Zhang, Shenzhen (CN); Sheng Ren, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 0 days.

(21) Appl. No.: 15/415,905

(22) Filed: Jan. 26, 2017

(65) Prior Publication Data

US 2018/0115828 A1 Apr. 26, 2018

(30) Foreign Application Priority Data

Oct. 25, 2016 (CN) ..... 2016 2 1164390 U

(51) Int. Cl.
*H04R 9/00* (2006.01)
*H04R 9/02* (2006.01)
*H04R 9/06* (2006.01)

(52) U.S. Cl.
CPC ..... *H04R 9/02* (2013.01); *H04R 9/025* (2013.01); *H04R 9/06* (2013.01); *H04R 2209/027* (2013.01); *H04R 2400/11* (2013.01)

(58) Field of Classification Search
CPC ..... H04R 19/00; H04R 19/01; H04R 19/013; H04R 19/016; H04R 9/00; H04R 9/025; H04R 9/027
USPC ..... 381/191, 396, 412, 420, 422
See application file for complete search history.

(56) References Cited

U.S. PATENT DOCUMENTS 3,651,283 A * 3/1972 Doschek ..... H04R 9/022 381/413
6,522,762 B1 * 2/2003 Mullenborn ..... H04R 19/005 367/181
8,270,661 B2 * 9/2012 Sorensen ..... H04R 9/063 381/401
8,565,471 B2 * 10/2013 Marugami ..... H04R 9/02 381/398
8,660,292 B2 * 2/2014 Li ..... H02K 33/16 381/396
2012/0160597 A1 * 6/2012 Li ..... H04R 7/04 181/157

* cited by examiner

*Primary Examiner* — Suhan Ni
(74) *Attorney, Agent, or Firm* — Na Xu; IPro, PLLC

(57) ABSTRACT

A loudspeaker, includes a front cover; a frame forming an accommodation space together with the front cover, the frame including a side wall; a vibration system accommodated in the accommodation space; and a magnetic circuit system accommodated in the accommodation space. The magnetic circuit system includes a yoke and a magnet disposed on the yoke, and the yoke includes a support plate and a bending wall extending perpendicularly from an edge of the support plate. Some gaps are formed between the bending walls and the side wall of the frame for containing glue, and the side wall forms a plurality of lockholes communicated with the gaps.

4 Claims, 2 Drawing Sheets

LOUDSPEAKER

FIELD OF THE PRESENT DISCLOSURE

The present disclosure relates to the field of electroacoustic transducers, and more particularly to a loudspeaker.

DESCRIPTION OF RELATED ART

For a loudspeaker related to existing technologies, a vibration system and a magnetic circuit are generally fixed by a support plate cooperating with a frame, however, the cooperation between the frame and the support plate is usually achieved by glue, due to the different materials of the support plate and the frame, after the glue filled between the edge of the support plate and the inside wall in the frame is solidified, it is easy to fall off due to the vibration brought by an external force, and bring more potential risks to the quality of the loudspeaker.

Thereof, it is necessary to disclose and provide an improved loudspeaker to overcome the above-mentioned disadvantage.

BRIEF DESCRIPTION OF THE DRAWINGS

Many aspects of the embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE EXEMPLARY EMBODIMENT

The present disclosure will hereinafter be described in detail with reference to an exemplary embodiment. To make the technical problems to be solved, technical solutions and beneficial effects of the present disclosure more apparent, the present disclosure is described in further detail together with the figures and the embodiment. It should be understood the specific embodiment described hereby is only to explain this disclosure, not intended to limit this disclosure.

Figure 1:
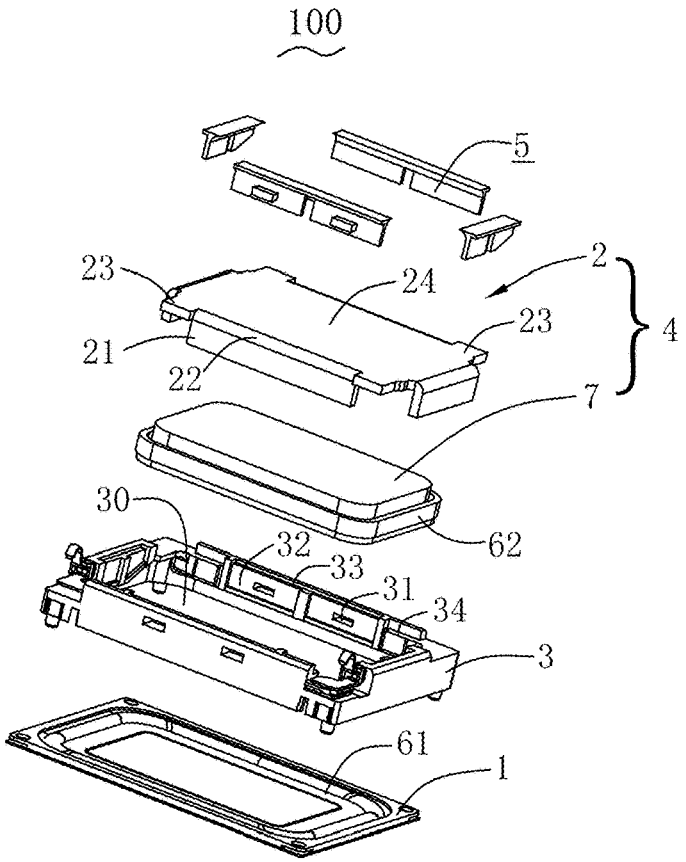
FIG. 1 is an exploded view of a loudspeaker in accordance with an exemplary embodiment of the present disclosure.
Figure 2:
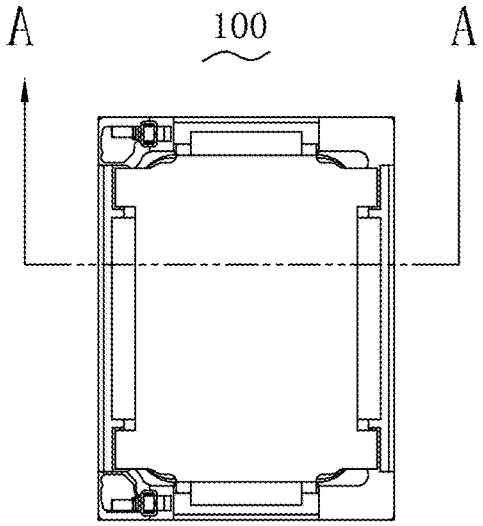
FIG. 2 is a top view of the loudspeaker in FIG. 1.
Figure 3:
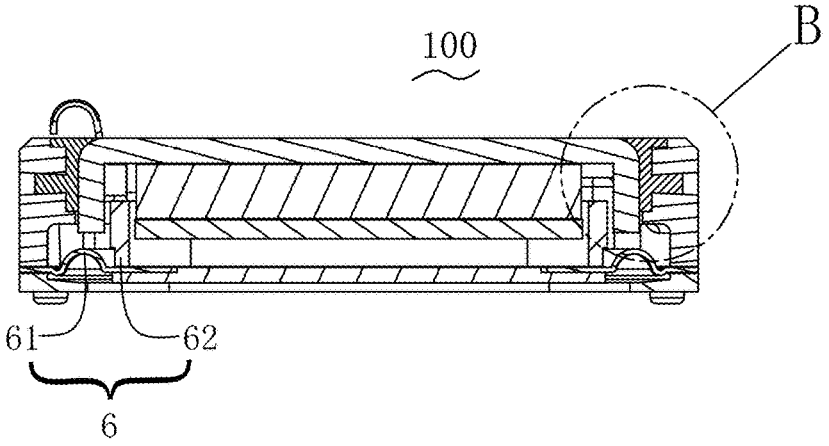
FIG. 3 is a cross-sectional view of the loudspeaker in FIG. 2, taken along line A-A.
Figure 4:
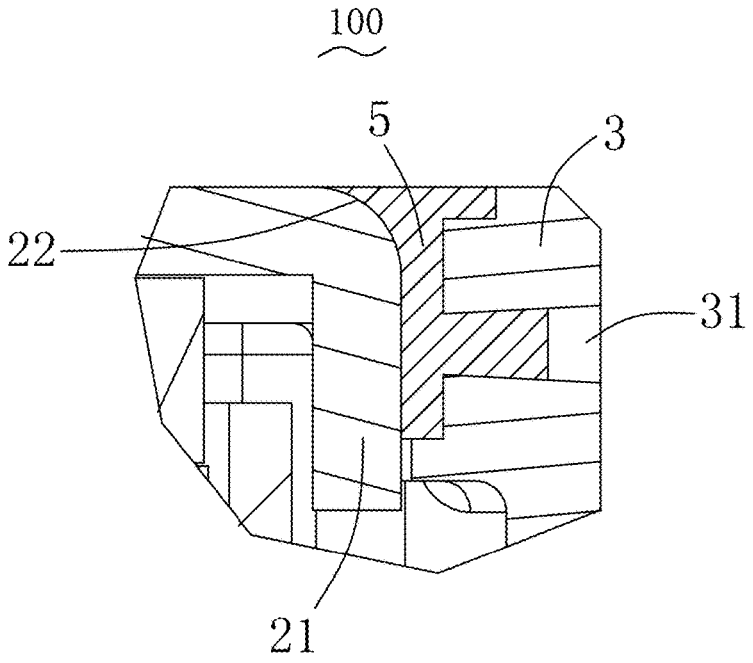
FIG. 4 is an enlarged view of Part B in FIG. 3.

As shown in FIGS. 1-4, a loudspeaker in accordance with an exemplary embodiment of the present disclosure includes a front cover 1, a frame 3 forming an accommodation space 30 with the front cover 1, a vibration system 6 and a magnetic circuit system 4 both accommodated in the accommodation space 30. The magnetic circuit system 4 comprises a yoke 2 and a magnet 7 located at a central portion of the yoke 2. The vibration system 6 comprises a diaphragm 61 and a voice coil 62 driving the diaphragm to vibrate and produce sound.

The yoke 2 comprises a support plate 24 in the shape of an approximate rectangular flat plate, a plurality of overlap sides 23 extending towards the frame 3 from the support plate 24, and a plurality of bending wall 21 extending perpendicularly from an edge of the support plate 24. Each bending wall 21 is located between two adjacent overlap sides 23. The overlap side 23 is coplanar with the support plate 24, and the bending wall 21 is perpendicular to the support plate 24.

The frame 3 comprises a pair of a first side wall 33 parallel to each other and a pair of second side walls 35 connected the two first side walls 33 respectively. The first side walls 33 and the second side walls 35 cooperatively form the accommodation space. Each first side wall 33 comprises an inner surface facing the yoke 2 and an outer surface opposed to the inner surface. A groove 32 is formed in the inner surface concaved toward the outer surface. A lockhole 31 is formed in the groove 32 by recessed from a bottom of the groove 32. Optionally, the lockhole 31 penetrates the first side wall 33. Each of the first side wall 33 forms a plurality of grooves 32 and a plurality of corresponding lockholes 31. The lockhole 32 communicates with the groove 32. The first side wall 33 further forms a plurality of stuck grooves 34 corresponding to the overlap sides 23.

After assembly, the yoke 2 is accommodated in the accommodation space 30 of the frame 3, and is positioned by and fixed to the side walls of the frame 3. The overlap sides 23 are accommodated in the stuck grooves 34 for engaging with the first side wall 33 to restrict the position of the support plate 24, which improves the structure stability of the loudspeaker. At the same time, by virtue of the structure mentioned above, it is easier to inject glue for assembling the components and solidify the glue.

A plurality of gaps 22 is formed between the bending wall 21 of the yoke 2 and the first side wall 33 or the second side wall 35 of the frame 3 where the glue 5 can be injected into, for fixing the yoke in the frame 3. The gap 22 is communicated with the grooves 32 and lockholes 31, so that the glue is flowed into the lockhole 31. It can reinforce the adhesion of the solidified glue effectively, in order to connect the support plate 2 and frame 3 steadily and reliably, and prevent the solidified glue from falling off effectively.

It is to be understood, however, that even though numerous characteristics and advantages of the present exemplary embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A loudspeaker, comprising:

a front cover;

a frame forming an accommodation space together with the front cover, the frame including a side wall;

a vibration system accommodated in the accommodation space, the vibration system including a diaphragm and a voice coil driving the diaphragm to vibrate and produce sound;

a magnetic circuit system accommodated in the accommodation space, the magnetic circuit system including a yoke and a magnet disposed on the yoke, and the yoke comprising a support plate and a bending wall extending perpendicularly from an edge of the support plate;

wherein a plurality of gaps are formed between the bending walls and the side wall of the frame for containing glue, and the side wall forms a plurality of lockholes communicated with the gaps, the side wall forms a plurality of grooves concaved from an inner surface toward an outer surface, each of the groove forms one lockhole in a bottom thereof so that the lockholes are communicated with the grooves.

2. The loudspeaker as described in claim 1, wherein the lockhole penetrates the side wall of the frame.

3. The loudspeaker as described in claim 1, wherein the yoke further includes a plurality of overlap sides extending parallel from the support plate.

4. The loudspeaker as described in claim 3, wherein the bending wall is perpendicular to the overlap side.

* * * * *